US005098055A

United States Patent [19]

Leonian

[11] Patent Number: 5,098,055

[45] Date of Patent: Mar. 24, 1992

[54] SELF-ADJUSTMENT HOOK AND SLING SUSPENSION FOR ROLLED SHEET MATERIALS

[76] Inventor: Phillip M. Leonian, 80 Central Park West, Apt. 25B, New York, N.Y. 10023

[21] Appl. No.: 608,254

[22] Filed: Nov. 2, 1990

[51] Int. Cl.[5] ..... B65H 19/00

[52] U.S. Cl. ..... 248/317; 242/55.2

[58] Field of Search ..... 248/317, 328, 340; 242/55.2

[56] References Cited

U.S. PATENT DOCUMENTS

| | | | |
|---|---|---|---|
| 182,317 | 9/1876 | Johnson | 248/317 X |
| 833,238 | 10/1906 | Pitschke | 242/55.2 |
| 1,375,224 | 4/1921 | MacLewee | 248/328 X |
| 4,226,380 | 10/1980 | Gay | 242/55 |
| 4,294,425 | 10/1981 | Weber | 248/328 X |
| 4,858,840 | 8/1989 | Kidman | 242/55.2 |

FOREIGN PATENT DOCUMENTS

| | | | |
|---|---|---|---|
| 560586 | 7/1923 | France | 242/55.2 |
| 799211 | 7/1933 | France | 242/55.2 |

*Primary Examiner*—Alvin C. Chin-Shue

*Attorney, Agent, or Firm*—Tilton Fallon Lungmus

[57] ABSTRACT

A compact, highly-portable hook and sling suspension assembly for rolled sheet materials (including partially or substantially unrolled sheet materials) such as background paper rolls commonly used in photography. The assembly includes a suspension cable with a pair of generally C-shaped hooks at its opposite ends. Each hook has an upper shank portion, a vertical back portion, and a horizontal insert portion. A linear relationship between the merger point of the back and insert portions, the hook's point of attachment to the cable, and the cable's central suspension point, results in a self-adjusting assembly which is highly effective in suspending a roll of sheet material and in permitting that material to be unrolled (and re-rolled) without damaging the ends of the roll or the side edges of the sheet material.

18 Claims, 1 Drawing Sheet

SELF-ADJUSTMENT HOOK AND SLING SUSPENSION FOR ROLLED SHEET MATERIALS

BACKGROUND AND SUMMARY

Large rolls of sheet material are available for use in photography, product displays, and wherever a temporary backdrop, usually plain but sometimes decorated, is needed. In photographic procedures, rolls of background paper are commonly suspended by inserting a rod through the roll and then attaching the ends of the rod to a pair of lightstands or to a pair of wall or ceiling brackets. Such an arrangement is depicted in FIG. 1 where it will be seen that a roll 10 of sheet material has a rod 11 extending through it. The ends of the rod are supported by brackets 12 carried by a pair of lightstands 13 that in turn rest upon a floor or other support surface.

Such arrangement, although simple, has major shortcomings. Portability is adversely affected by the need to provide two separate lightstands as well as a rod 11 which must be of a length exceeding that of roll 10. While a "short" roll typically is 53 inches in length, if such equipment is to have the capability of supporting rolls of greater length, then the rod must obviously have a length exceeding that of the longest roll to be supported. Such problems might be reduced by forming the rod in sections that can then be joined together to form whatever length is needed, but the requirement for such a rod, even if segmented, nevertheless increases the number and bulk of equipment items that must be transported to and from, or made available at, a work site.

One aspect of this invention lies in providing a highly-effective suspension system that eliminates the need for a support rod and at least one of the lightstands and, therefore, greatly increases the portability of such a support system. A sling suspension is utilized, the system including a pair of hooks adapted to engage the ends of a roll of sheet material and a cable joined to the hooks for central attachment to a single lightstand or other suitable supporting means. Although only a single suspension point is utilized, there is no danger that the suspension cable might engage the ends of a roll to damage those ends, or the side edges of the sheet material of the roll, and interfere with unrolling (and re-rolling, where desired) of the sheet material. The avoidance of such problems results from the distinctive configuration of the hooks and their relationship to other elements of the combination.

Each hook of the pair is generally C-shaped in configuration having an upper shank portion, a base portion, and a lower insert portion. The hooks may be formed of cylindrical bar stock so that the surfaces of the respective portions are rounded and smooth. Of particular importance is the fact that the back and insert portions are substantially straight and merge with each at a right-angled corner.

The shank portion of each hook is connected to one end of the cable at an attachment point. The cable length is selected, based on the length of a roll to be supported by the assembly, so that the attachment point of the cable to each hook is disposed in linear alignment with both the right-angled corner of the hook and the central suspension point from which the cable, and hence the entire assembly, is supported. The result is a system in which the hooks are self-adjusting when their insert portions are received in the open ends of a roll. More particularly, the straight insert portions of the respective hooks become horizontally aligned with each other and the straight back portions of the hooks assume vertical positions against the vertical end faces of the horizontally-extending roll.

Stated differently, when the cable is supported at its mid-point and the insert portions of the hooks are placed within the open ends of a roll of sheet material, the cable and the roll assume the outline of an isosceles triangle. Each equal side of the triangle is defined by the cable and by a projection line coaxial therewith extending through the attachment point (between the end of the cable and the hook) to the right-angled corner of the hook. As a result, the hooks convert the angular suspension forces of the cable into a vertical force vector which is applied upwardly against the engaged undersurface (or inner surface) of the roll and a horizontal force vector which is applied inwardly against the end surfaces of the roll. The angle formed by the imaginary line of projection and the insert portion of each hook should fall within the range of approximately 10 to 45 degrees, preferably 15 to 30 degrees.

Other features, advantages, and objects will appear from the specification and drawings.

DRAWINGS

DETAILED DESCRIPTION OF PREFERRED EMBODIMENTS

Figure 1:
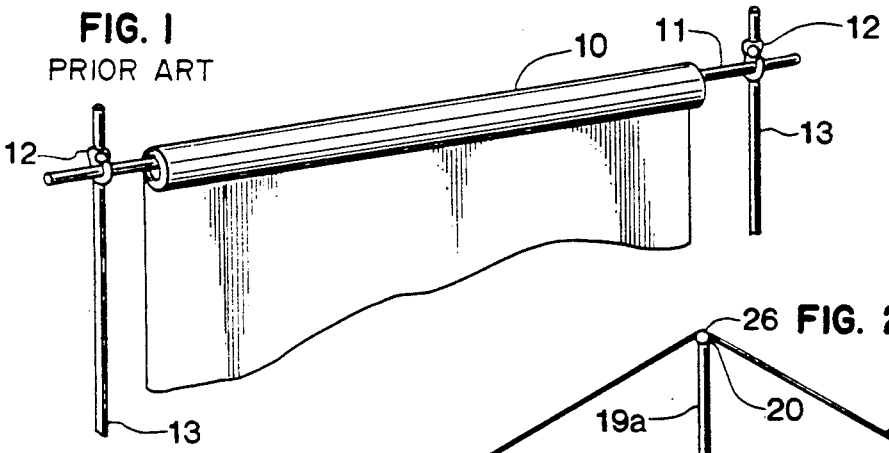
FIG. 1 PRIOR ART
FIG. 1 is a perspective view depicting the prior art as described above.
Figure 2:
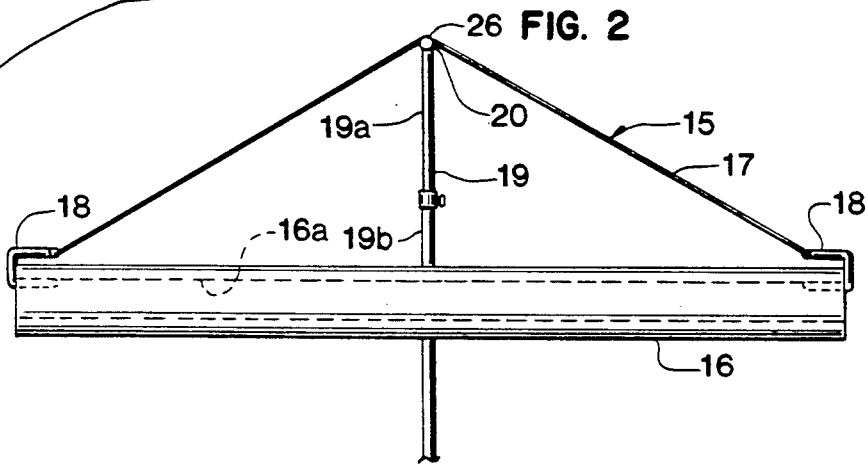
FIG. 2 is a side elevational view showing the suspension assembly of the present invention.

Referring to FIGS. 2-5, the numeral 15 generally designates a suspension assembly for supporting a roll of sheet material 16 such as, for example, a roll of background paper of the type commonly used in photographic studios. Such a roll is open-ended and tubular, that is, it has a cylindrical axial opening **16*a*** for its full longitudinal extent. In the drawings, the tubular roll is shown in fully-rolled condition, but it is to be understood in use that portions of the sheet material are unrolled to provide a backdrop for objects to be photographed or displayed.

The suspension assembly includes a suspension cable 17 and a pair of hooks 18 connected to the ends of the cable. Means are provided for supporting the cable at a central suspension point equidistant from the ends of the cable. In the illustration given, the support means takes the form of a vertical standard 19 having a plurality of telescoping sections **19*a* and 19*b*. The standard also includes a base (not shown) and may, if desired, take the form of the telescoping tubular stand shown and described in copending application Ser. No. 608253, filed Nov. 21, 1990. A suitable fitting 20** for retaining or supporting the cable at its longitudinal mid-point is provided at the top of the standard.

Each hook 18 is generally C-shaped in configuration, having an upper shank portion 21, a vertical back portion 22, and a lower insert portion 23. The back portion and insert portions are substantially straight and merge with each other at a right-angled corner 24. In the illustration given, the shank and insert portions are parallel and approximately equal in length; however, neither parallelism nor equality in length should be regarded as an essential requirement. The length of the insert portion 23 may vary considerably, the main objective being to provide that portion with sufficient length to securely support an end of the tubular roll 16 when the insert portion is received therein.

Figure 3:
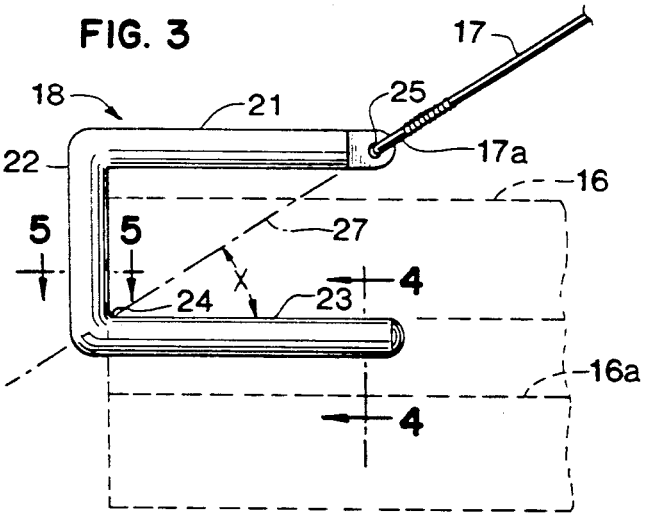
FIG. 3 is an enlarged elevational view showing one of the hooks and its relationship to the cable and a roll of sheet material when the suspension assembly is in use.

Cable 17 has each end 17*a* connected to the shank portion 21 of a hook at an attachment point designated by numeral 25 in FIG. 3. For that purpose, the free end of the shank portion 21 may be provided with an opening through which the end portion 17*a* of the suspension cable extends.

Figure 5:
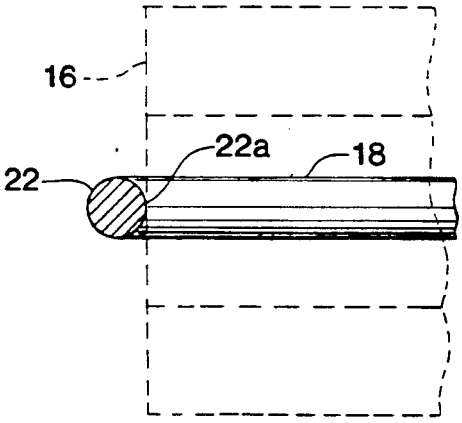
FIG. 5 is an enlarged sectional view taken along line 5—5 of FIG. 3.
Figure 4:
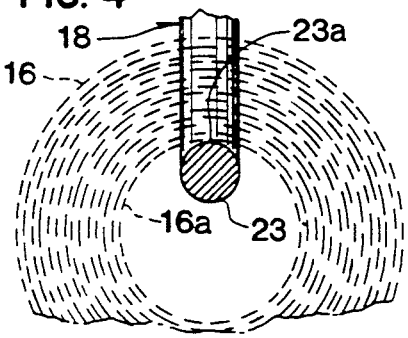
FIG. 4 is an enlarged fragmentary cross sectional view taken along line 4—4 of FIG. 3.

The shank, back, and insert portions 21–23 of each hook are coplanar and preferably integrally formed. If desired, each hook may be formed from a cylindrical rod of aluminum or other suitable metal bent into the C-shaped configuration shown; however, other suitable materials such as lightweight rigid plastics may be used. Those surfaces of the hook that directly contact a roll of sheet material—specifically, the upper surface 23*a* of insert portion 23 and the inwardly-facing surface 22*a* of back portion 22—should be rounded or arcuate when viewed in section (FIGS. 4, 5).

In use of the suspension assembly, a critical relationship exists between cable 17 and hooks 18. As shown in FIG. 3, if an imaginary line 27 were projected beyond suspension point 25 in the same direction as cable 17, that line would pass through right-angled corner 24. Also, the angle x formed by the intersection of that line with the insert portion 23 would fall within the general range of 10 to 45 degrees, preferably 15 to 30 degrees.

Where the suspension assembly is supported from a single suspension point 26 at the longitudinal mid-point of cable 17, that suspension point, attachment point 25, and corner 24 for each hook are in rectilinear alignment. Such a relationship is achieved by selecting a cable 17 that is sufficiently longer than the roll 16 to be supported by the system so that a desired angle x is created and points 24–26 are aligned. Under such conditions, the cable 17, its linear extensions 27, and roll 16 (more precisely, the longitudinal inside upper surface of the roll) form the outline of an isosceles triangle. The equal-length stretches of cable on opposite sides of suspension point 26 are tensioned to retain the insert portions 23 of the hooks within the open ends of roll 16 of the hook and to maintain the roll in the horizontal condition shown. Because of the relationships described, the hooks are stabilized with insert portions 23 extending horizontally and back portions 22 extending vertically, the back portions being urged into engagement with the vertical ends of the roll and the insert portions engaging the horizontal upper inside surfaces of the roll's end portions. Since back portions 22 extend vertically, the risk that suspension forces exerted by the hooks might damage the ends of the roll, or the side edges of the sheet material of that roll, are eliminated or at least greatly reduced.

Figure 6:
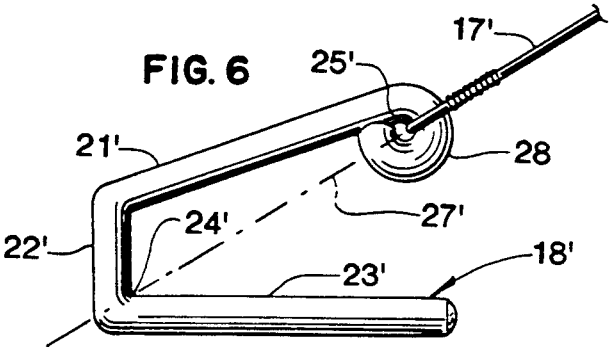
FIG. 6 is an elevational view of a modified hook that may be used in the suspension assembly of this invention

FIG. 6 depicts a hook 18' that is similar to the hooks already described except that shank portion 21' and insert portion 23' are not parallel but diverge outwardly from back portion 22'. Such an arrangement permits the attachment portion of the hook to be formed by bending the material of the hook backwardly upon itself to form an eye 28. Despite the size and location of the eye, no interference between the eye and the outer surface of a roll can occur because the divergence of portions 21' and 23' positions the eye above the upper end of back portion 22' and therefore well above the outer surface of the largest roll the hook is capable of supporting.

In other respects, the hook 18' of FIG. 6 is similar to hook 18. The relationships described in connection with the first embodiment also characterize a suspension system utilizing the hook of FIG. 6. An imaginary line 27' projected beyond the end of cable 17 intersects the rightangled junction of horizontal insert portion 23' and vertical backing portion 22'.

While in the foregoing I have disclosed embodiments of the invention in considerable detail for purposes of illustration, it will be understood by those skilled in the art that many of these details may be varied without departing from the spirit and scope of the invention.

I claim:

1. A suspension assembly for use in supporting an open-ended horizontal roll of sheet material comprising a suspension cable having a pair of ends and a central suspension point equidistant therebetween; and a pair of generally C-shaped hooks each having an upper shank portion, a back portion, and a lower insert portion extending along a single plane; said back and insert portions each being substantially straight; said shank and back portions meeting each other at a first corner and said back and insert portions meeting each other at right angles at a second corner; said shank portion of each hook being connected to one end of said cable at an attachment point; said cable being of a selected length, based on the length of a roll to be supported thereby, so that said attachment point for each hook is disposed in linear alignment with both said right-angled second corner and said suspension point, said back portions are vertically disposed, and said insert portions of the respective hooks extend towards each other in horizontal alignment, when said insert portions are received in the opposite ends of an open-ended roll and said roll is supported by said cable from said suspension point.

2. The assembly of claim 1 in which a straight line projected through each said second corner and said attachment point meets said second corner at an angle relative to said insert portion within the range of about 10 to 45 degrees.

3. The assembly of claim 2 in which said angle falls within a preferred range of 15 to 30 degrees.

4. The assembly of claim 1 in which said shank, back, and insert portions of both hooks are coplanar with said cable when said assembly supports a roll of sheet material.

5. The assembly of claims 1 or 2 in which said insert portion has an arcuate top surface when viewed in cross section.

6. The assembly of claim 5 in which said insert portion is cylindrical in shape.

7. The assembly of claims 1 or 2 in which said back portion has an inner surface facing in the direction of said shank and insert portions that is arcuate when viewed in cross section.

8. The assembly of claim 7 in which said back portion is cylindrical in shape.

9. The assembly of claims 1 or 2 in which said shank, back, and insert portions of each hook are integrally formed from a cylindrical bar.

10. In combination with an open-ended roll of sheet material, a suspension cable having a pair of ends and a central suspension point equidistant therebetween; a pair of generally C-shaped hooks each having an upper shank portion, a back portion, and a lower insert portion extending along a single plane; said back and insert portions each being substantially straight; said shank and back portions meeting each other at a first corner and said back and insert portions meeting each other at right angles at a second corner; said shank portion of each hook being connected to one end of said cable at an attachment point; means for supporting said cable at said suspension point; said insert portions of said hooks being inserted into said open ends of said roll; said cable having a selected length greater than said roll so that when said roll is supported by said cable from said suspension point said cable and roll together form an outline of an isosceles triangle, said attachment point for each hook is disposed in linear alignment with both said right-angled second corner and said suspension point, said back portions are vertically disposed, and said insert portions of the respective hooks are horizontally oriented and aligned with each other.

11. The combination of claim 10 in which a straight line projected through each said second corner and said attachment points meets said second corner at an angle relative to said insert portion within the range of about 10 to 45 degrees.

12. The combination of claim 11 in which said angle falls within the preferred range of 15 to 30 degrees.

13. The combination of claims 10 or 11 in which said shank, back, and insert portions of both of said hooks are coplanar with said cable and each other when said roll of sheet material is suspended by said hooks and said cable at said suspension point of said cable.

14. The combination of claims 10 or 11 in which said insert portion has an arcuate top surface when viewed in cross section.

15. The combination of claim 14 in which said insert portion is cylindrical in shape.

16. The combination of claims 10 or 11 in which said back portion has an inner surface facing in the direction of said shank and insert portions that is arcuate when viewed in cross section.

17. The combination of claim 16 in which said back portion is cylindrical in shape.

18. The combination of claims 10 or 11 in which said shank, back, and insert portions of each hook are integrally formed from a cylindrical bar.

* * * * *